US009016186B2

(12) United States Patent
Asaf et al.

(10) Patent No.: US 9,016,186 B2
(45) Date of Patent: Apr. 28, 2015

(54) VEHICLE UNDERBELLY SYSTEM

(71) Applicant: Plasan Sasa Ltd., M.P. Marom Hagalil (IL)

(72) Inventors: Zvi Asaf, Kibbutz Afek (IL); Guy Golan, M.P. Marom Hagalil (IL); Itzhak Kuchuk-Katalan, Kibbutz Dafna (IL); Michael Bogomolny, M.P. Marom Hagalil (IL)

(73) Assignee: Plasan Sasa Ltd., M.P. Marom Hagalil (IL)

( * ) Notice: Subject to any disclaimer, the term of this patent is extended or adjusted under 35 U.S.C. 154(b) by 0 days.

(21) Appl. No.: 14/172,467

(22) Filed: Feb. 4, 2014

(65) Prior Publication Data

US 2014/0318359 A1 Oct. 30, 2014

(30) Foreign Application Priority Data

Feb. 5, 2013 (IL) ..... 224575

(51) Int. Cl.
*F41H 11/00* (2006.01)
*F41H 5/007* (2006.01)
*F41H 7/04* (2006.01)

(52) U.S. Cl.
CPC ..... *F41H 5/007* (2013.01); *F41H 7/042* (2013.01)

(58) Field of Classification Search
USPC ..... 89/36.17, 36.09, 36.08
See application file for complete search history.

(56) References Cited

U.S. PATENT DOCUMENTS

| | | | | |
|---|---|---|---|---|
| 8,739,676 | B2 * | 6/2014 | Ames | 89/36.08 |
| 8,783,157 | B2 * | 7/2014 | Pavon | 89/36.17 |
| 2006/0086243 | A1 * | 4/2006 | Seo et al. | 89/36.17 |
| 2012/0031260 | A1 * | 2/2012 | Warren | 89/36.02 |
| 2013/0092016 | A1 * | 4/2013 | Sales | 89/36.08 |

FOREIGN PATENT DOCUMENTS

| | | |
|---|---|---|
| WO | WO 0239048 | 5/2002 |
| WO | WO 2012052768 | 4/2012 |

* cited by examiner

*Primary Examiner* — J. Woodrow Eldred
(74) *Attorney, Agent, or Firm* — Dorsey & Whitney LLP

(57) ABSTRACT

An underbelly system for a vehicle. The system includes: a deflector configured to be disposed under a cabin structure of the vehicle and constitute an underbelly thereof; a plurality of explosive charges, each being associated with a different deformable portion of the deflector and configured, upon charge detonation, for deforming its corresponding deformable portion of the deflector to project in a direction away from the cabin structure relative to its original structure; a sensing arrangement configured for sensing an external detonation under the vehicle and obtaining detonation data of the external detonation; and a control unit, in communication with the sensing arrangement and the explosive charges, configured for receiving said detonation data, and initiating detonation of two or more selected explosive charges in a sequential manner corresponding to said detonation data.

9 Claims, 11 Drawing Sheets

VEHICLE UNDERBELLY SYSTEM

CROSS-REFERENCE TO RELATED APPLICATIONS

This application claims priority to Israel Application No. 224575 filed on 5 Feb. 2013, the disclosure of which is incorporated herein, in its entirety, by this reference.

TECHNOLOGICAL FIELD

The presently disclosed subject matter relates to armor system, and more particularly to systems for protecting an underbelly of a vehicle.

BACKGROUND

Vehicles with underbelly systems for deflecting a shockwave generated by detonation of a threat under the vehicle are known, for example, from WO2012/052768 and WO02/39048.

GENERAL DESCRIPTION

According to one aspect of the presently disclosed subject matter, there is provided an underbelly system for a vehicle, comprising:

a deflector configured to be disposed under a cabin structure of the vehicle and constitute an underbelly thereof;

a plurality of explosive charges, each being associated with a different deformable portion of the deflector and configured, upon charge detonation, for deforming its corresponding deformable portion of the deflector to project in a direction away from the cabin structure relative to its original structure;

a sensing arrangement configured for sensing an external detonation under the vehicle and obtaining detonation data of the external detonation; and a control unit, in communication with the sensing arrangement and the explosive charges, configured for receiving said detonation data, and initiating detonation of two or more selected explosive charges in a sequential manner corresponding to said detonation data.

The underbelly system of the presently disclosed subject matter is configured for reducing the influence (i.e., the detonation force) of a detonation under the vehicle which may cause the vehicle to accelerate rapidly into the air and result in serious damage to the vehicle and its occupant. This influence is reduced by detonation of selected explosive charges which deform the deflector which thereby deflects the shockwave from its original orientation to the sides of the vehicle.

The term 'threat' refers hereinafter in the specification and the claims to any explosive device which may be detonated under a vehicle, and can be, for example, an explosively formed penetrator/projectile (EFP) or a land mine.

The sequential manner of the detonation of the selected explosive charges can be configured to cause at least a portion of the deflector, optionally the portion whose associated explosive charge is detonated first, to project in a direction away from the cabin structure to a greater extent than that obtained in said portion upon simultaneous detonation of the selected charges.

The control unit can be configured for analyzing the detonation data to obtain shockwave parameters, related to a shockwave generated upon the external detonation, including one or more of the following: a location of a peak of the shockwave, a direction at which the shockwave progresses, a duration of the shockwave, a magnitude distribution of the shockwave, and a spatial geometry of the shockwave.

The control unit can further be configured for determining said sequential manner by calculating a detonation sequence for initiating the detonation of the selected explosive charges in accordance with the shockwave parameters so as to gradually deflect the shockwave during the progression thereof and reduce its impact on the cabin structure of the vehicle.

The two or more selected explosive charges can include at least one first explosive charge and at least one second explosive charge configured to be detonated following the detonation of the first explosive charge.

The first explosive charge can be selected to be the explosive charge which is the most proximal to the location of the peak of the shockwave.

The control unit can further be configured for selecting out of said plurality of explosive charges two or more explosive charges to be detonated in accordance with the shockwave parameters.

The sensing arrangement can comprise at least one of the following: one or more optical sensors, one or more electromagnetic pulse sensors, one or more temperature sensors, and one or more pressure sensors.

The sensing arrangement can be configured for collecting the detonation data prior to impact of the shockwave on the deflector.

Each of the explosive charges can be attached to an inner surface of its corresponding deformable portion of the deflector.

The explosive charges can be successively disposed widthwise in a direction transverse to a longitudinal axis of the vehicle.

The explosive charges can be arranged as an array of $M \times N$ explosive charges which includes M lines of lengthwise explosive charges arranged along a longitudinal axis of the vehicle and N rows of widthwise explosive charges arranged perpendicularly to the longitudinal axis of the vehicle, when $M \geq 1$ and $N \geq 1$.

The deflector can have at least one lowermost deflector central portion and at least two deflector peripheral portions elevated above the deflector central portion.

The explosive charges which are associated with the deflector central portion can have a greater explosive power than the explosive charges which are associated with the deflector peripheral portions.

The deflector central portion can have a thickness greater than the thickness of the deflector peripheral portions.

The deflector central portion and the deflector peripheral portions can be separate members of the deflector which are configured to at least partially disconnect from each other upon detonation of at least one explosive charge which is associated with the deflector central portion.

The underbelly system can further comprise a support construction disposed between the cabin structure of the vehicle and the deflector and at least partially confining the explosive charges.

The deflector can constitute an armor panel having ballistic characteristics.

The underbelly system can be an add-on configured to be mounted to the cabin structure of the vehicle.

According to another aspect of the presently disclosed subject matter, there is provided a vehicle with the above underbelly system.

According to another aspect of the presently disclosed subject matter, there is provided a method for protecting a vehicle having the above underbelly system. The method comprises steps of:

sensing by the sensing arrangement external detonation under the vehicle, obtaining detonation data and providing the detonation data to the control unit;

receiving said detonation data from the sensing arrangement at the control unit; and initiating, by the control unit, detonation of two or more selected explosive charges in a sequential manner corresponding to said detonation data.

The method can further comprise a step of analyzing the detonation data, and thereby obtaining shockwave parameters, related to a shockwave generated upon the external detonation, including one or more of the following: a location of a peak of the shockwave, a direction at which the shockwave progresses, a duration of the shockwave, a magnitude distribution of the shockwave, and a spatial geometry of the shockwave.

The method can further comprise a step of selecting, by the control unit, out of said plurality of explosive charges two or more explosive charges to be detonated in accordance with the shockwave parameters.

The method can further comprise a step of determining, by the control unit, said sequential manner by calculating a detonation sequence for initiating the detonation of the selected explosive charges so as to gradually deflect the shockwave during the progression thereof and respective interaction with the deflector.

According to another aspect of the presently disclosed subject matter, there is provided an underbelly system for a vehicle, comprising:

a deflector configured to be disposed under a cabin structure of the vehicle and constitute an underbelly thereof;

at least one explosive charge, disposed between the deflector and the cabin structure of the vehicle, being associated with a deformable portion of the deflector and configured upon its detonation for deforming said deformable portion of the deflector in a direction away from the vehicle; and an energy absorbing arrangement disposed between the at least one explosive charge and the cabin structure of the vehicle configured for reducing loads exerted on the cabin structure upon detonation of the at least one explosive charge.

The underbelly system can further comprise: a sensing arrangement configured for sensing an external detonation under the vehicle and obtaining detonation data of the external detonation; and a control unit, in communication with the sensing arrangement and the explosive charges, configured for receiving said detonation data, and initiating detonation of two or more selected explosive charges in a sequential manner corresponding to said detonation data.

The energy absorbing arrangement can further be configured for reducing the loads exerted on the cabin structure of the vehicle upon the external detonation.

The energy absorbing arrangement can be configured to be compressed during the external detonation, thereby absorbing at least a part of the energy generated by said detonation under the vehicle.

The energy absorbing arrangement can comprise a plurality of energy absorbing units, each configured to be compressed upon detonation of the explosive charge or external detonation, thereby absorbing a part of the energy generated by said detonation of the explosive charge or said external detonation.

The underbelly system can further comprise a support construction having a first portion associated with the deflector and a second portion associated with the energy absorbing arrangement.

The energy absorbing arrangement can have a first portion connected to the second portion of the support construction and a second portion configured to be mounted to the cabin structure of the vehicle.

According to another aspect of the presently disclosed subject matter, there is provided an underbelly system for a vehicle, comprising:

a deflector configured to be disposed under a cabin structure of the vehicle and constitute an underbelly thereof;

at least one explosive charge associated with a deformable portion of the deflector and configured to be detonated upon an external detonation under the vehicle for deforming said deformable portion of the deflector in a direction away from the vehicle; and a support construction for supporting to the deflector with the explosive charges, so that each of a majority of explosive charges is disposed closer to its corresponding deformable portion than to a closest region of the support construction, so that a detonation pressure that is generated upon the detonation of the explosive charge is greater on the deformable portion than on the support structure.

The explosive charge can be attached to the deformable portion.

The supporting structure can include at least one reinforcing rib connected to the deflector at an area thereof free of charges, optionally to two reinforcing ribs, defining therebetween a channel extending along a longitudinal axis of the vehicle.

The support structure can form a space within said channel configured to accommodate at least a part of explosive gases generated upon detonation of the at least one explosive charge disposed within the channel, thereby reducing the pressure actuated on the cabin structure of the vehicle by the explosive gases.

The channel can be configured for directing therealong at least a part of explosive gases generated upon detonation of the explosive charge, and thereby reducing pressure actuated on the cabin structure of the vehicle by the explosive gases.

The channel can be defined by a channel wall which includes an upper channel portion substantially parallel to a floor of the cabin structure of the vehicle and at least one side channel portion substantially perpendicular to the upper channel portion.

The upper channel portion or the at least one side channel portion can constitute a reinforcing rib of the underbelly system.

The support construction can further comprise a gas evacuation mechanism configured for evacuating at least part of the explosive gases generated upon the detonation of the explosive charge in a direction transverse to the longitudinal axis of the vehicle.

The gas evacuation mechanism can be constituted by a plurality of openings formed in the at least one side channel portion so as to allow evacuating at least part of the explosive gases therethrough.

The openings can be spaced at a predetermined distance therebetween.

The deflector can have a lowermost deflector central portion and two deflector peripheral portions.

The support construction can comprise at least three channels, including: at least one primary channel associated with the deflector central portion and at least two secondary channels, each of which is associated with its corresponding deflector peripheral portion.

The at least one explosive charge can be constituted by a plurality of explosive charges, including: at least one primary explosive charge at least partially confined by the primary channel and the deflector central portion; and at least two secondary explosive charges, each at least partially confined by its corresponding secondary channel and its corresponding deflector peripheral portion.

The at least one primary explosive charge can have a greater explosive power than the at least two secondary explosive charges.

The deflector central portion and the deflector peripheral portions can be configured to be at least partially disconnected from each other at least upon detonation of the primary explosive charge for allowing evacuation of the explosive gases from the interior of the underbelly system.

The primary channel can comprise a protective plate disposed between the at least one primary charge and the upper channel portion of the primary channel and substantially parallel to the upper channel portion.

The protective plate can be configured for substantially preventing influence of the detonation of the at least one explosive charge on the cabin structure of the vehicle and for directing the explosive gases towards the openings.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1A:
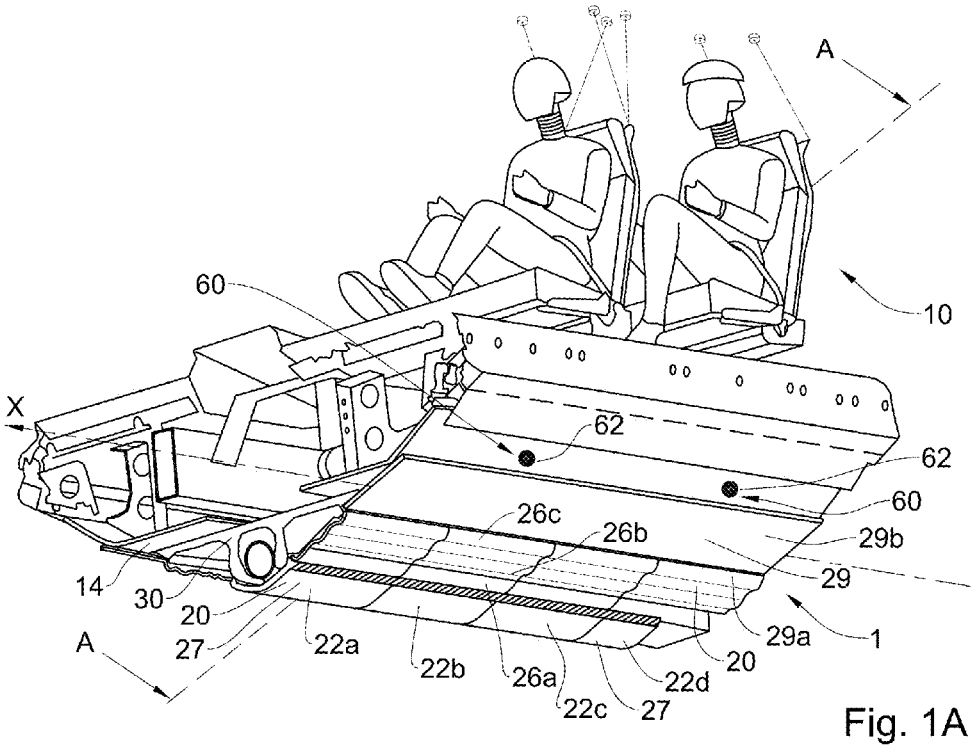
FIG. 1A is a partial perspective view of a vehicle with an underbelly system, in accordance with one example of the presently disclosed subject matter.
Figure 1B:
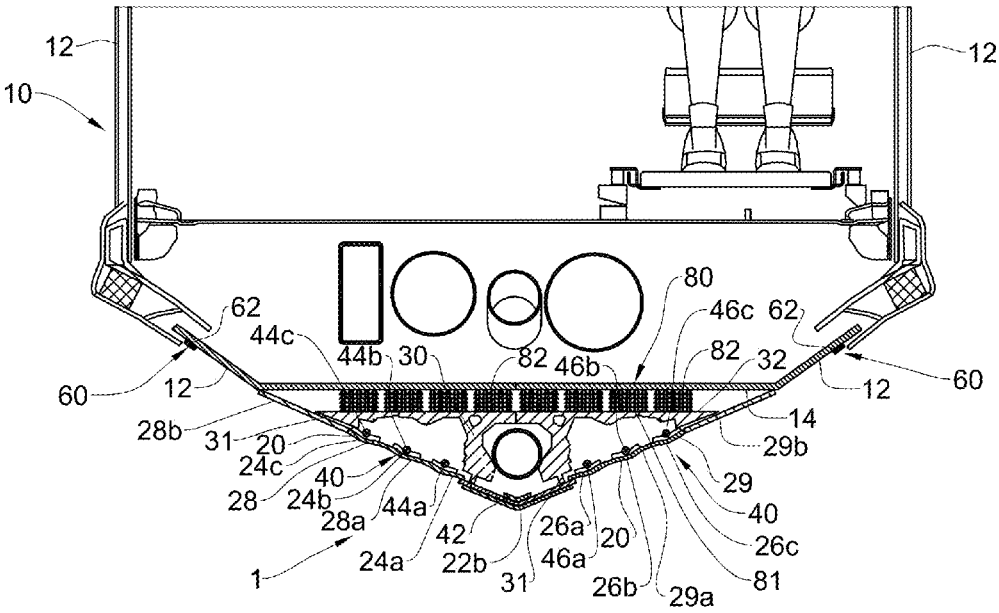
FIG. 1B is a cross-sectional view along line A-A in FIG. 1A.

Attention is first directed to FIGS. 1A and 1B of the drawings illustrating an underbelly system 1 being mounted to a vehicle 10 in accordance with one example of the presently disclosed subject matter.

The vehicle 10 has a cabin structure 12 defining an outer shell of the vehicle 10. The cabin structure 12 has a vehicle belly 14 to which the underbelly system 1 is mounted as an add-on. It is appreciated that according to other examples, the underbelly system 1 can be an integral part of the vehicle 10.

The underbelly system 1 is an active armor system which is configured for providing an active protection against detonation of a threat under the vehicle.

The underbelly system 1 comprises the followings components: a deflector 20; a plurality of explosive charges 40; a support construction 30 configured for supporting deflector 20 with the explosive charges 40 and confining the explosive charges 40 therein; a sensing arrangement 60 configured for sensing an external detonation of a threat under the vehicle 10; and a control unit (not shown) in communication with the sensing arrangement 60 and the explosive charges 40, for managing the operation of the underbelly system 1, and particularly to receive input from the sensing arrangement 60 and to provide output to the selected explosive charges 40 and initiate their detonation.

The deflector 20 is an armor panel having ballistic characteristics. The deflector 20 is disposed under the cabin structure 12 and constitutes an underbelly of the vehicle 10. Each of the explosive charges 40 is mounted to a different deformable portion of the deflector 20 and configured, upon its detonation, for deforming its corresponding deformable portion of the deflector 20 to project in a direction away from the cabin structure 12 relative to its original structure.

In general, the underbelly system 1 is configured to detect an external detonation of a threat under the vehicle by the sensing arrangement 60, and actively react to this detonation by deflecting a shockwave that is generated upon the external detonation at the location of the shock wave and in a gradual manner which corresponds to the progression of the shockwave, and thereby reducing the impact of the shockwave on the cabin structure 12 of the vehicle 10. The deflection of the shockwave is performed by exploding selected explosive charges 40 according to a calculated detonation sequence for outwardly deforming the corresponding deflector portions of the deflector 20, which when encountering the shockwave, at least partially change the direction of propagation of the shockwave so as to deflect the shockwave in a gradual manner. It is appreciated that a gradual manner of deflection is more efficient than a non-gradual deflection (in which all the explosive charges are detonated at the same time) due to the nature of the shockwave and its continuous progression. In particular, the sequential manner of the detonation of the selected explosive charges causes at least a portion of the deflector 20, optionally the portion whose associated explosive charge is detonated first, to project in a direction away from the cabin structure to a greater extent than that obtained in said portion upon simultaneous detonation of the selected charges.

According to the present example, the underbelly system 1 includes twenty eight explosive charges 40 which are arranged as an array of seven lines×four rows (M×N). The seven lines (M=7) of lengthwise explosive charges are disposed along a longitudinal axis X of the vehicle 10, and the four rows (N=4) of widthwise explosive charges arranged perpendicularly to the longitudinal axis X.

The deflector 20 is composed of a lowermost deflector central portion 27, a right deflector peripheral portion 28 and a left deflector peripheral portion 29, all extending along the axis X. The right and left peripheral portions 28 and 29 are elevated above the deflector central portion 27. The right peripheral portion 28 is constructed of two parts: a right deformable part 28*a* and a right extension part 28*b*. The left peripheral portion 29 is constructed of two parts: a left deformable part 29*a* and a left extension part 29*b*. The deflector central portion 27 has a thickness greater than the thickness of the right and left deflector peripheral portions 28 and 29.

The deflector central portion 27 is structured of four deformable portions 22*a*, 22*b*, 22*c* and 22*d*, one of these deformable portions constitutes a primary deformable portion 22*b*. The right deformable part 28*a* is divided to twelve secondary deformable portions, which include secondary deformable portions 24*a*, 24*b* and 24*c*. The left deformable part 29*a* is divided to twelve secondary deformable portions, which include secondary deformable portions 26*a*, 26*b* and 26*c*.

The array of twenty eight explosive charges includes a central line of four primary explosive charges disposed attached to the deflector central portion 27. One of the primary explosive charges is a primary explosive charge 42. The array further has six peripheral lines of secondary explosive charges attached to the right and left deflector peripheral portions 28 and 29, which include secondary explosive charges 44*a*, 44*b*, 44*c*, 46*a*, 46*b* and 46*c*.

Each of the four primary deformable portions and the twenty four secondary deformable portions is associated with its corresponding explosive charge. For example, the primary explosive charge 42 is attached to an inner surface of the primary deformable portion 22*b*, and the secondary explosive charges 44*a*, 44*b* and 44*c* are attached to inner surfaces of the secondary deformable portion 24*a*, 24*b* and 24*c*, respectively. The secondary explosive charges 46*a*, 46*b* and 46*c* are attached to inner surfaces of the secondary deformable portion 26*a*, 26*b* and 26*c*, respectively. Due to the proximity of the deflector central portion 27 to a potential threat, the primary explosive charges have a greater explosive power than the secondary explosive charges.

The deflector central portion 27 and the right and left deflector peripheral portions 28 and 29 are separate members of the deflector 20 and are configured to at least partially disconnect from each other upon detonation of at least one primary explosive charge.

The sensing arrangement 60 includes optical sensors 62 which are configured for collecting the detonation data which characterize the shockwave that is generated upon the detonation of the threat. The optical sensors 62 are able to sense the shockwave substantially immediately after its generation, and prior to its impact on the deflector 20. This allows the underbelly system 1 to react so as to deflect the shockwave in a continuous and an efficient manner.

The sensing arrangement 60 is configured for sensing an external detonation of a threat under the vehicle and obtaining detonation data of the external detonation. The control unit is configured for receiving said detonation data, and initiating detonation of two or more selected explosive charges in a sequential manner corresponding to said detonation data. A detailed explanation of the operation of the underbelly system 1 is provided below with respect to FIG. 2.

It is appreciated that the sequential manner of the detonation of the selected explosive charges causes the sequential manner of the detonation of the selected explosive charges causes at least a portion of the deflector 20, optionally the portion whose associated explosive charge is detonated first, to project in a direction away from the cabin structure to a greater extent than that obtained in said portion upon simultaneous detonation of the selected charges. In other words, the sequential manner of the detonation of the selected explosive charges causes the deflector to assume a concave shape (with respect to its original shape) which extends to a greater extent than a shape which the deflector would assume upon simultaneous detonation of the selected charges. The concave shape achieved by the simultaneous detonation is more efficient in deflecting the shockwave to the surrounding of the vehicle, and thereby reducing the loads exerted on the cabin structure 12 of the vehicle.

The underbelly system 1 further includes an energy absorbing arrangement 80, in accordance with another aspect of the presently disclosed subject matter. The energy absorbing arrangement 80 is configured for reducing loads exerted on the cabin structure 12 upon detonation of at least one of the explosive charges 40 or the external detonation. The energy absorbing arrangement 80 comprises a plurality of energy absorbing units 82, each configured to be respectively compressed upon detonation of at least one of the explosive charges 40 or the external detonation, thereby absorbing a part of the energy generated by said detonation of the explosive charge or said external detonation.

The support construction 30 has a first portion 31 associated with the deflector 20 and a second portion 32 associated with the energy absorbing arrangement 80. The energy absorbing arrangement 80 has a first portion 81 connected to the second portion 32 of the support construction 30 and a second portion configured to be mounted to the cabin structure 12 of the vehicle 10.

The control unit has a processor and a memory. The memory stores a computer program which is useful for operating the underbelly system 1, and the processor executes the computer program for performing the method of FIG. 2 detailed below.

Figure 2:
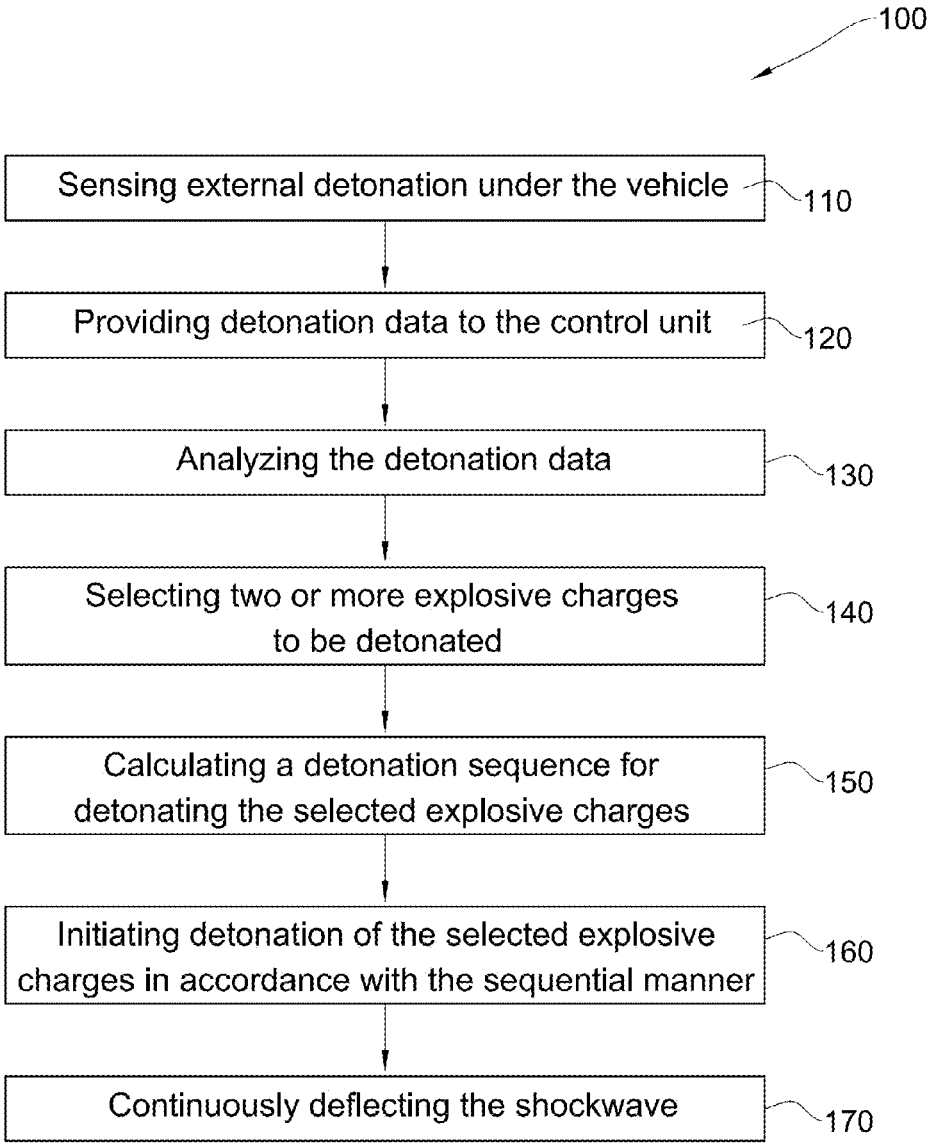
FIG. 2 is a schematic illustration of the method of operation of the underbelly system of FIGS. 1A and 1B.

Reference is now made to FIG. 2 which illustrates steps of a method 100 according to which the underbelly system 1 can be operated.

In step 110, the sensing arrangement 60 senses an external detonation of a threat under the vehicle and obtains detonation data related to the external detonation. The detonation data can be the signals which are generated by the optical sensors 62, and can include, for example, location and strength of a light signal generated upon the detonation and related to the shockwave generated upon the external detonation.

In step 120, the sensing arrangement 60 provides the detonation data to the control unit.

In step 130, the control unit receives and analyzes the detonation data to obtain shockwave parameters, related to the shockwave generated upon the external detonation. The shockwave parameters are physical parameters which characterize the shockwave, and can include, for example, one or more of the following parameters: a location of a peak of the shockwave, a direction at which the shockwave progresses, duration of the shockwave, a magnitude distribution of the shockwave, and a spatial geometry of the shockwave. By obtaining and using the shockwave parameters, the control unit can estimate the physical characteristics of the shockwave so as to deflect it in an efficient and a continuous manner.

In step 140, the control unit selects out of the explosive charges 40 two or more explosive charges to be detonated in accordance with the shockwave parameters. In this step, the control unit can, for example, choose a first explosive charge which is the first to be detonated, and a second explosive charge which will be detonated following the first explosive charge. The first explosive charge can be selected to be the explosive charge which is the most proximal to the location of the peak of the shockwave, which is one of the shockwave parameters. The second explosive charge can be a neighboring explosive charge to the first explosive charge.

In step 150, the control unit calculates the detonation sequence for detonating the selected explosive charges. The detonation sequence is defined according to the time intervals that should be elapsed the detonations of the selected explosive charges. The detonation sequence is calculated in accordance with the shockwave parameters so as to gradually deflect the shockwave during the progression thereof and its respective interaction with the deflector. By using the shockwave parameters which include data related to physical parameters such as the estimated strength, location and time at which the shockwave will encounter the deformable portions of the deflector, the control unit can estimate what is the most optimal time at which deflection of the shockwave should take place. This deflection can be provided by detonation of the selected explosive charges in accordance with the calculated detonation sequence and respective deformation of the respective deformable portions of the deflector 20.

In step 160, the control unit initiates the detonation of the selected explosive charges in accordance with the detonation sequence. In this step, the first explosive charge is detonated, and after a period of time, the second explosive charge is also detonated. This sequential detonation of the selected explosive charges causes sequential deformation of the respective deformable portions of the deflector 20. This sequential deformation results in step 160 in which the shockwave is gradually and continuously deflected from its original orientation, thereby reducing its impact on the cabin structure of the vehicle and its corresponding damage to the vehicle 1 and its occupants.

Reference is now made to FIGS. 3A to 3H, in which one example of the operation of the underbelly system 1 is illustrated in consecutive steps.

Figure 3A:
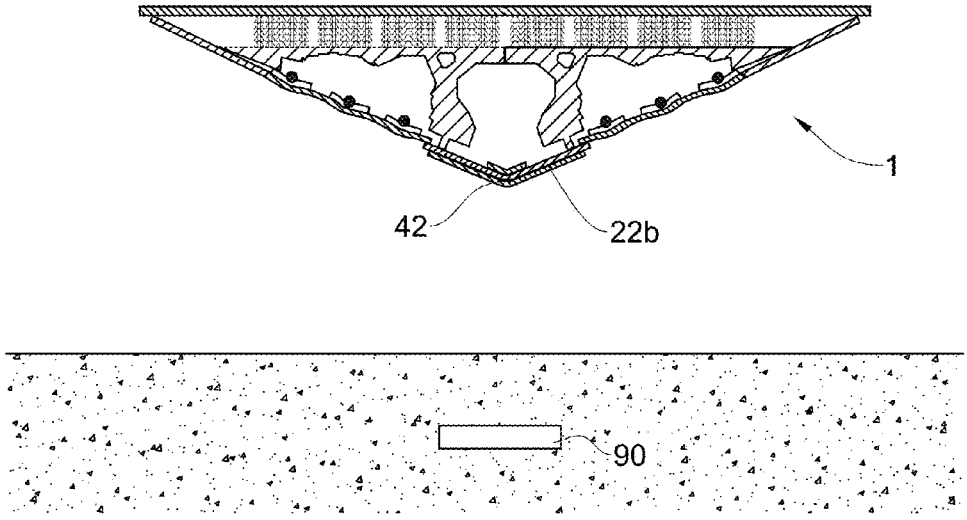
FIGS. 3A to 3H are cross-sectional views of consecutive steps of operation of the underbelly system of FIGS. 1A and 1B upon one example of a detonation under the vehicle.

As shown in FIG. 3A, when an external detonation of a threat 90 occurs under the vehicle 10, and a shockwave 92 (which is shown at its beginning in FIG. 3B) starts to be developed, the sensing arrangement 60 senses this detonation in the step 110, and respectively the steps 120, 130, 140 and 160 are executed by the control unit. In these steps, the shockwave parameters of the shockwave 92 are estimated, the explosive charges that are to be detonated are selected, the detonation sequence is calculated and the detonation of the selected explosive charges is initiated according to the detonation sequence.

Figure 3B:
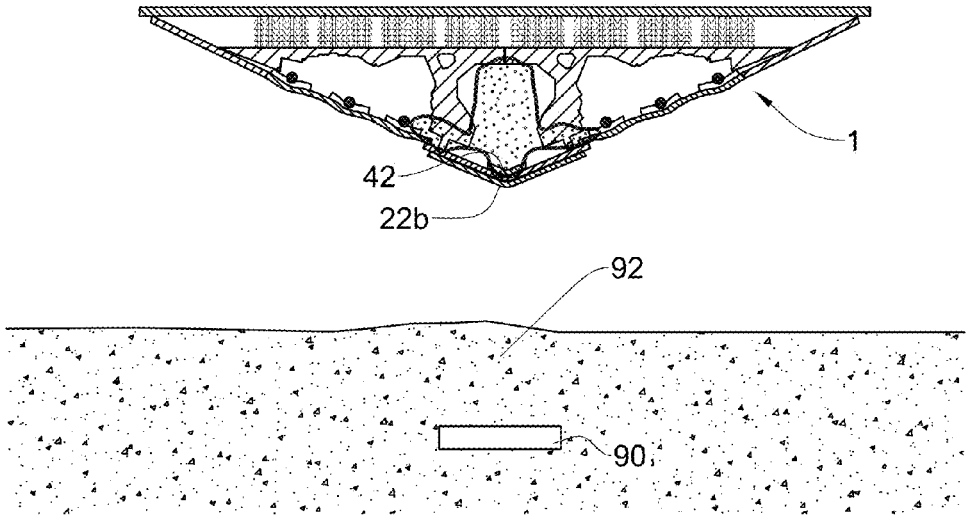
Figure 3C:
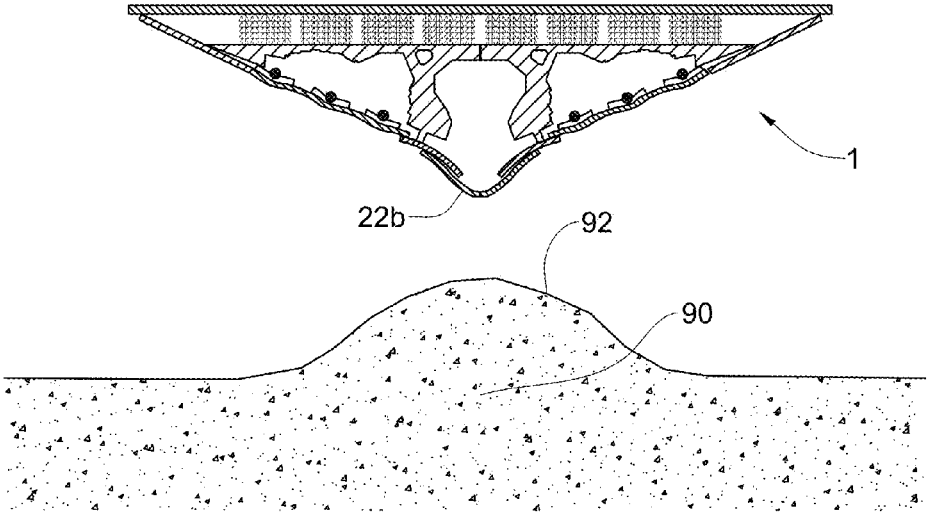
Figure 3D:
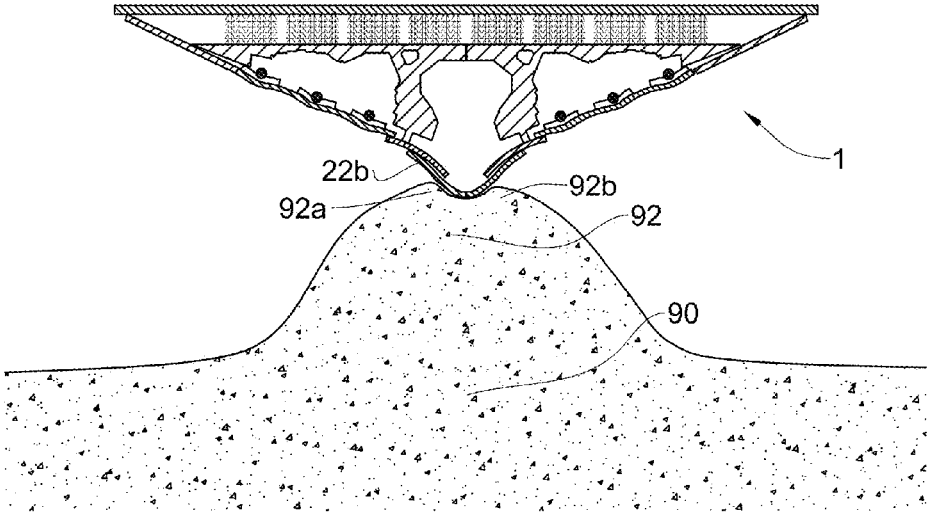
Figure 3E:
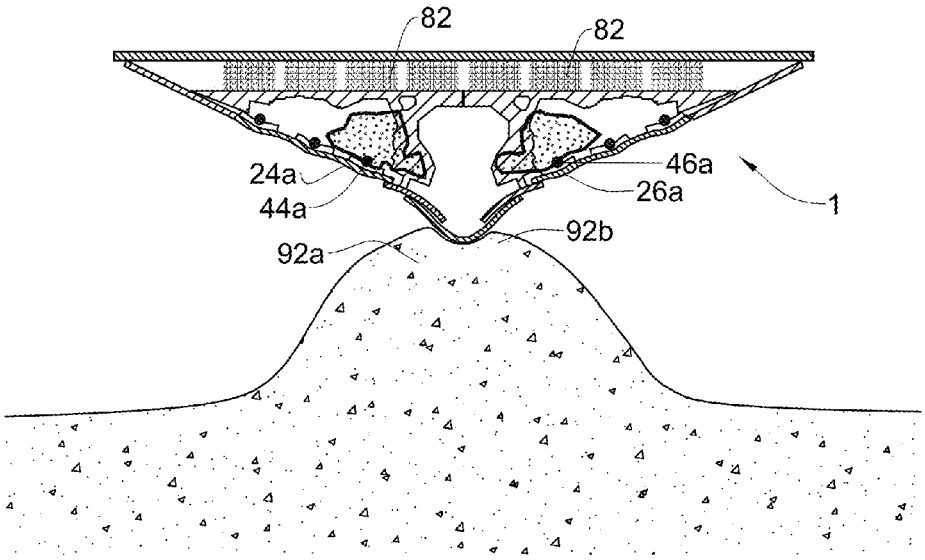
Figure 3F:
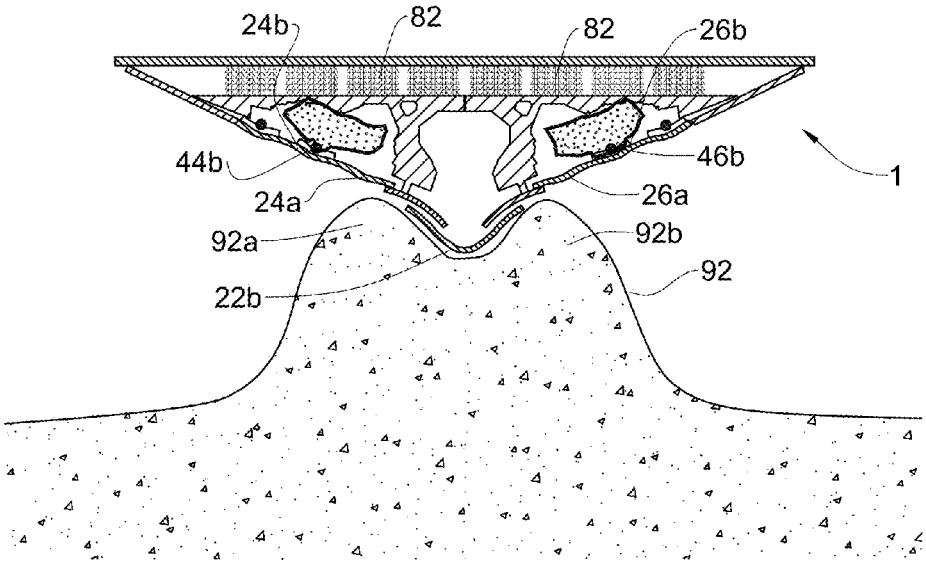
Figure 3G:
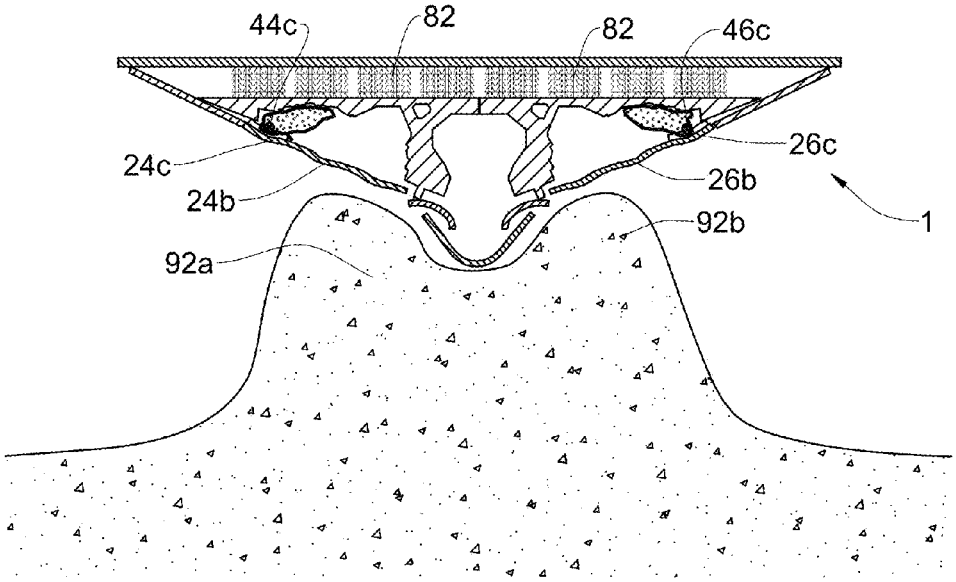
Figure 3H:
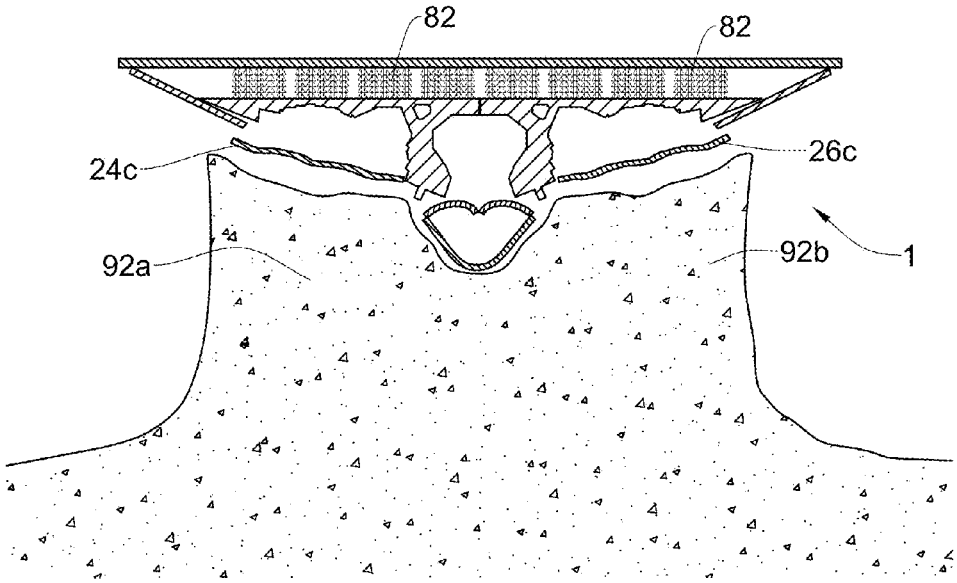

As shown in FIG. 3B, the primary explosive charge 42 is selected to be the first explosive charge to be detonated. This selection can be explained by the proximity of the primary explosive charge 42 to the location of the peak of the shockwave 92 (which is one of the shockwave parameters). The detonation of the primary explosive charge 42 results in an outward deformation of the primary deformable portion 22*b* towards the shockwave 92. As shown in FIG. 3C, when the deformed deformable portion 22*b* encounters the shockwave 92, the shockwave starts to be divided into two main shockwave parts 92*a* and 92*b*. In a three dimensional view, the shockwave parts 92*a* and 92*b* are constituted by a substantially round shaped hill surrounding the deformable portion 22*b*. At this moment the deflection of the shockwave 92 begins. As shown in FIG. 3E, after a very short period of time, according to the detonation sequence calculated by the control unit, the control unit initiates detonation of the secondary explosive charges 44*a* and 46*a*. These explosive charges are selected by the control unit due the spatial geometry of the shockwave 92 (which is one of the shockwave parameters). The detonation of the secondary explosive charges 44*a* and 46*a* results in an outward deformation of the secondary deformable portions 24*a* and 26*a* towards the shockwave parts 92*a* and 92*b*, respectively. As shown in FIG. 3F, when the shockwave parts 92*a* and 92*b* encounter the deformed secondary deformable portions 24*a* and 26*a*, a further deflection of the shockwave 92 occurs. As further shown in FIG. 3F, when the shockwave parts 92*a* and 92*b* encounter the secondary deformable portions 24*a* and 26*a*, the control unit initiates, according to the calculated detonation sequence, detonation of the secondary explosive charges 44*b* and 46*b*. As a result of this detonation, the secondary deformable portions 24*b* and 26*b* are deformed. As shown in FIG. 3G, when the shockwave parts 92*a* and 92*b* encounter the deformed secondary deformable portions 24*b* and 26*b*, a further deflection of the shockwave 92 occurs. As further shown in FIG. 3G, when the shockwave parts 92*a* and 92*b* encounter the secondary deformable portions 24*b* and 26*b*, the control unit initiates, according to the calculated detonation sequence, detonation of the secondary explosive charges 44*c* and 46*c*. As a result of this detonation, the secondary deformable portions 24*c* and 26*c* are outwardly deformed towards the shockwave parts 92*a* and 92*b*, respectively. As shown in FIG. 3H, when the shockwave parts 92*a* and 92*b* encounter the deformed secondary deformable portions 24*c* and 26*c*, a further deflection of the shockwave 92 occurs. The above described sequential manner of detonation of the selected explosive charges results in a gradually deflection of the shockwave 92, and respective gradual reduction of its impact of the cabin structure 12 of the vehicle 10. As can further be noticed in FIGS. 3B to 3G, the energy absorbing units 82 of the energy absorbing arrangement 80 are compressed and deformed during the detonation of the selected explosive charges and the impact of the shockwave 92. This compression and deformation of the energy absorbing units 82 allows absorbing a part of the energy generated by the detonation of the selected explosive charge and the shockwave 92.

As can be clearly seen from FIGS. 3A to 3G, the fact that the selected explosive charges are detonated in a sequential manner, allows the deflector to project in a direction away from the cabin structure to a greater extent than that obtained upon simultaneous detonation of the selected charges. The sequential manner allows the deflector to assume a sharpened shape which is sharper than a shape which the deflector could assume upon simultaneous detonation of the selected charges. This sharpened and concave shape of the deflector is more efficient in deflecting the shockwave to the surrounding of the vehicle than the shape that would be generated upon simultaneous detonation of the selected explosive charges. It should be noticed that upon simultaneous detonation of the selected charges, a much less sharp structure of the deflector is generated which is less efficient in deflecting the shockwave.

Reference is now made to FIGS. 4A to 4E, in which another example of the operation of the underbelly system 1 is illustrated in consecutive steps.

Figure 4A:
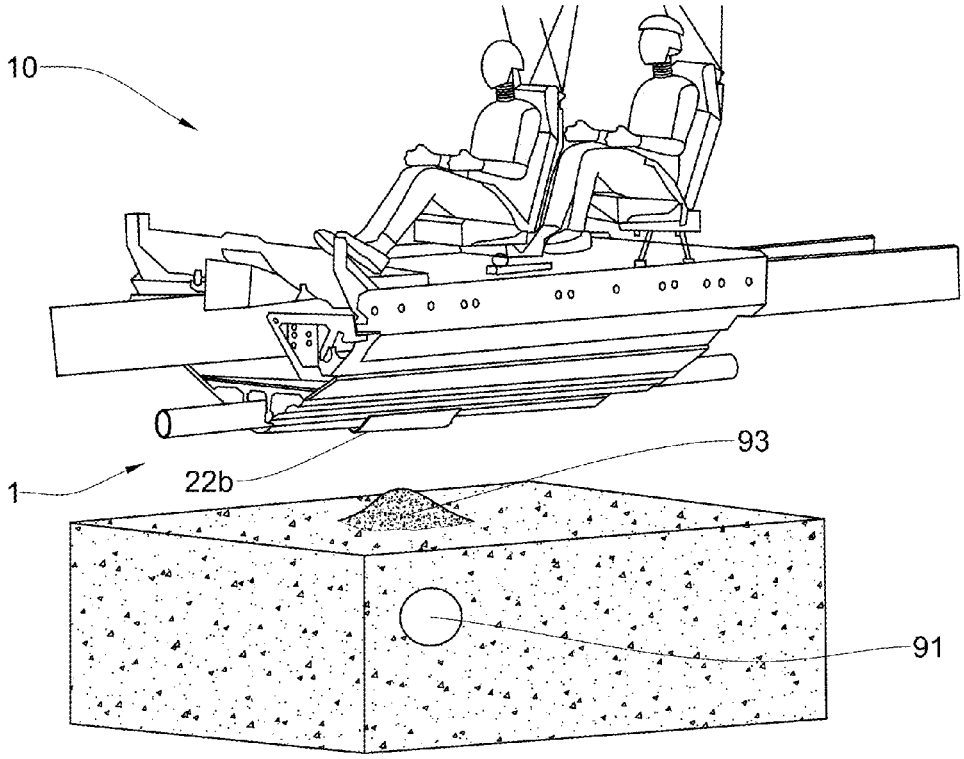
FIGS. 4A to 4E are cross-sectional views of consecutive steps of operation of the underbelly system of FIGS. 1A and 1B upon another example of a detonation under the vehicle.

As shown in FIG. 4A, when an external detonation of a threat 91 occurs under the vehicle 10, a shockwave 93 starts to be developed. Since the shockwave 93 is different from the shockwave 92, the shockwave parameters which are calculated by the control unit will also be different, and this will result in a different selection of the selected explosive charges to be detonated and a different detonation sequence.

Further to the generation of the shockwave 93, the sensing arrangement 60 senses this detonation in the step 110, and respectively the steps 120, 130, 140, 150 and 160 are executed by the control unit. In these steps, the shockwave parameters of the shockwave 93 are estimated, the selected explosive charges are selected, the detonation sequence is calculated and the detonation of the selected explosive charges is initiated according to the detonation sequence.

Figure 4B:
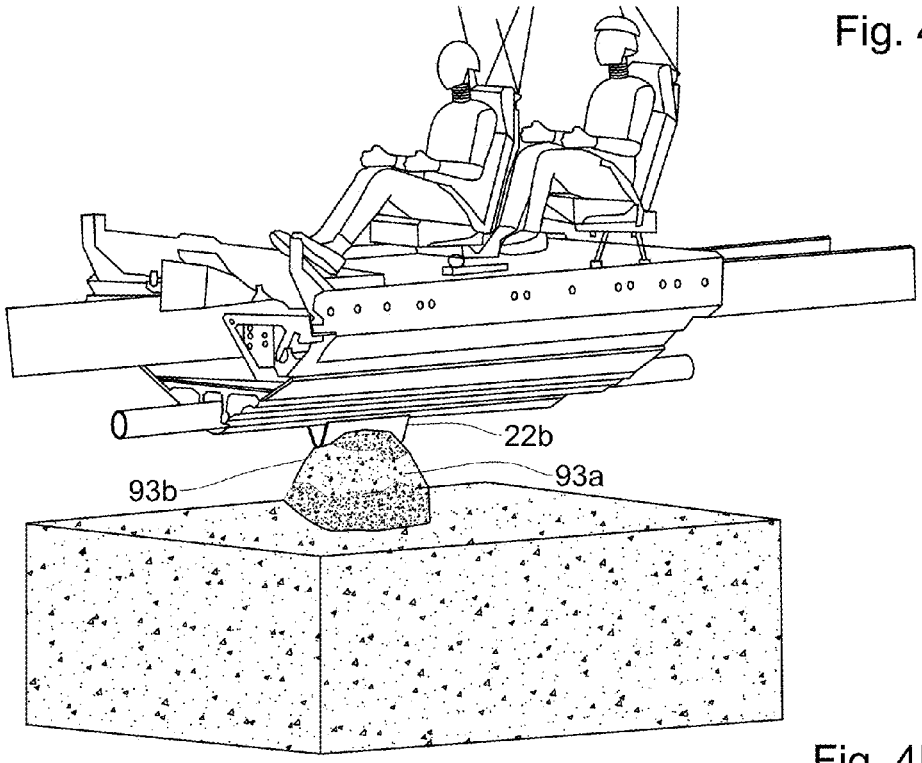
Figure 4C:
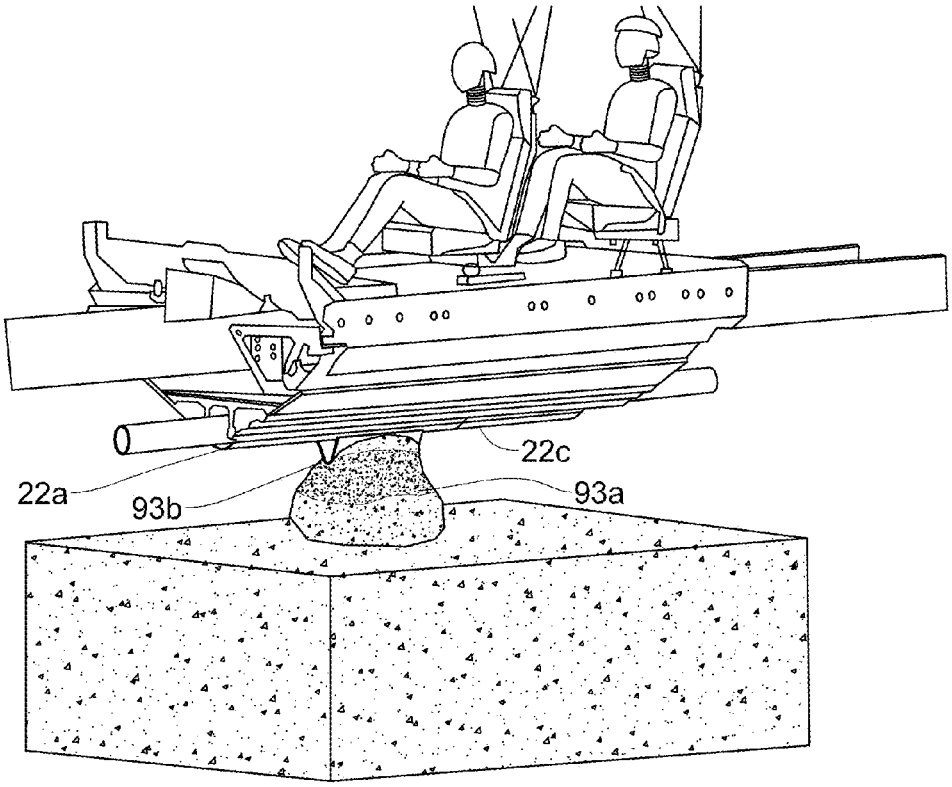
Figure 4D:
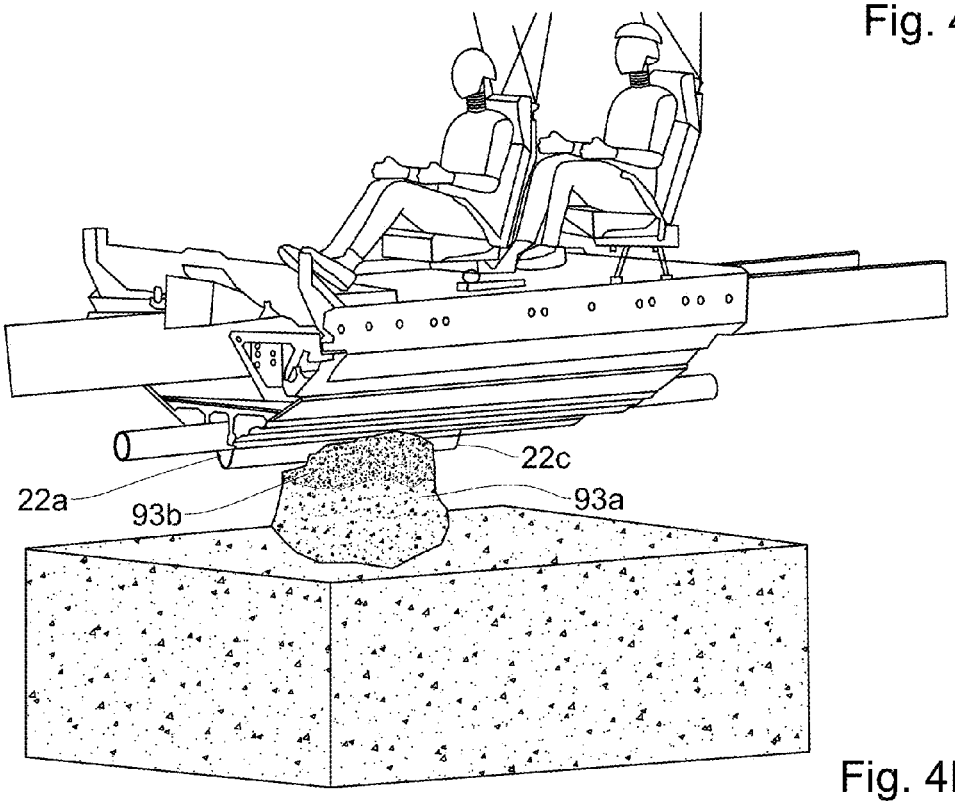
Figure 4E:
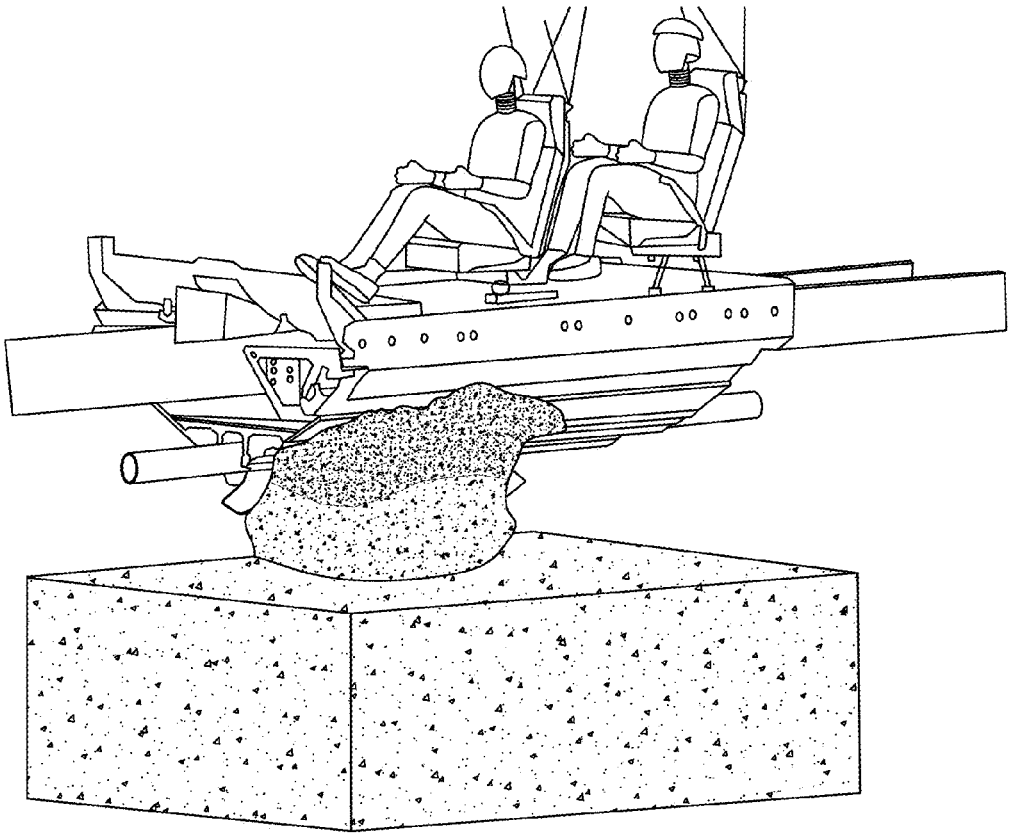

As shown in FIG. 4A, the primary explosive charge 42 is selected to be the first explosive charge to be detonated. This selection can be explained by the proximity of the primary explosive charge 42 to the location of the peak of the shockwave 93 (which is one of the shockwave parameters). The detonation of the primary explosive charge 42 results in an outward deformation of the primary deformable portion 22*b* towards the shockwave 93. As shown in FIG. 4B, when the deformed deformable portion 22*b* encounters the shockwave 93, the shockwave starts to be divided into two main shockwave parts 93*a* and 93*b*. At this moment the deflection of the shockwave 93 begins. As shown in FIG. 4C, after a very short period of time, according to the detonation sequence calculated by the control unit, the control unit initiates detonation of primary explosive charges neighboring to the primary explosive charge 42. The neighboring primary explosive charges are associated with the primary deformable portions 22*a* and 22*c*. According to the example of FIGS. 4A to 4E, the neighboring primary explosive charges are selected to be detonated due to physical characteristics of the shockwave 93 which are different from the physical characteristics of the shockwave 92. The detonation of said neighboring primary explosive charges results in an outward deformation of the primary deformable portions 22*a* and 22*c* towards the shockwave parts 93*a* and 93*b*, respectively. As shown in FIGS. 4D and 4E, when the shockwave parts 93*a* and 93*b* encounter the deformed primary deformable portions 22*a* and 22*c*, a further deflection of the shockwave 93 occurs. Following the detonation of the neighboring primary explosive charges, no further detonation of explosive charges occurs. The above described sequential manner of detonation of the three primary explosive charges results in gradual deflection of the shockwave 93, and respective gradual reduction of its impact of the cabin structure 12 of the vehicle 10.

Figure 5A:
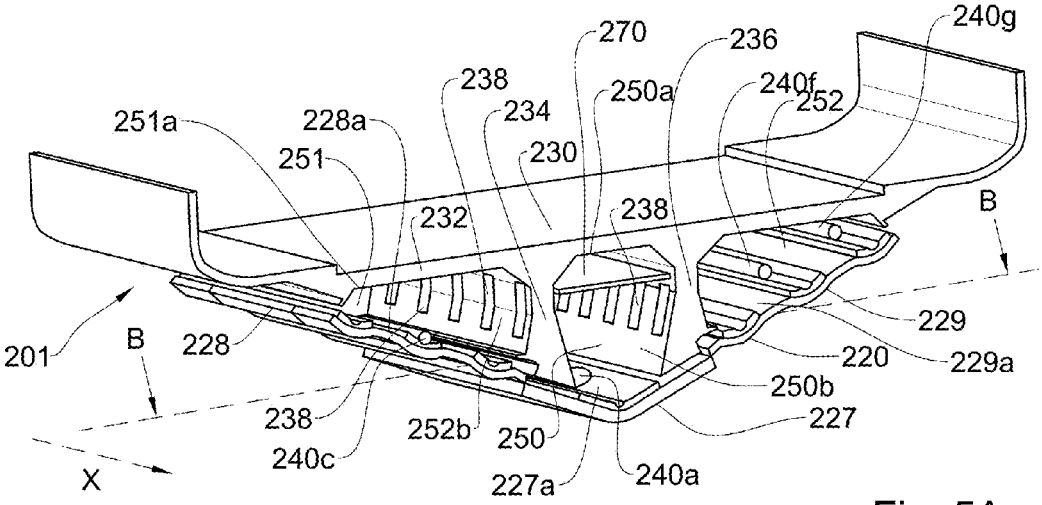
FIG. 5A is a detailed perspective view of the underbelly system of FIG. 1A.
Figure 5B:
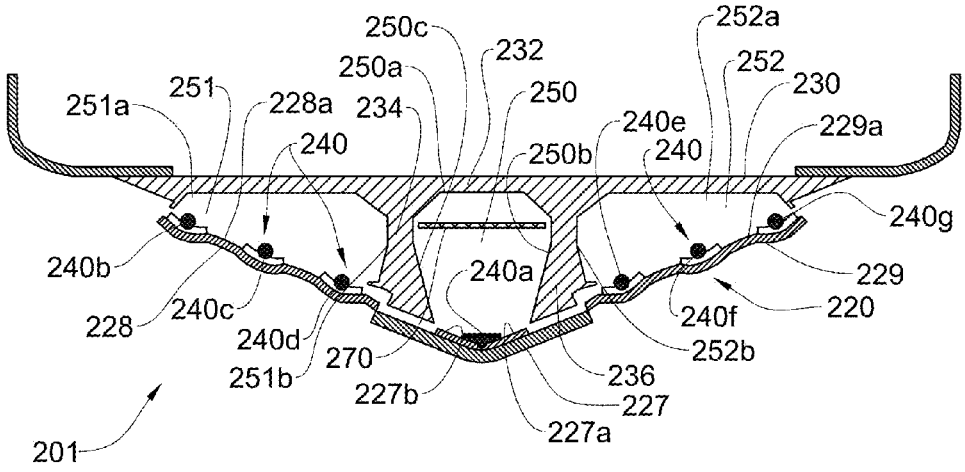
FIG. 5B is a cross-sectional view along line B-B in FIG. 5A.
Figure 5C:
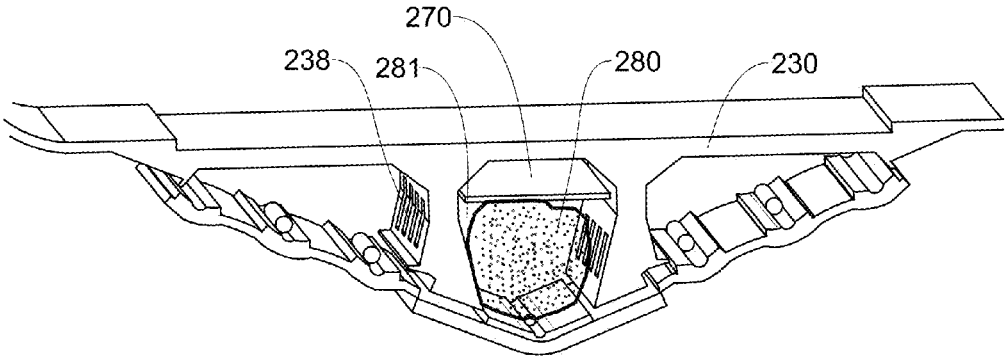
FIGS. 5C and 5D are cross-sectional views of consecutive steps of operation of the underbelly system of FIGS. 5A and 5B upon a detonation under the vehicle.
Figure 5D:
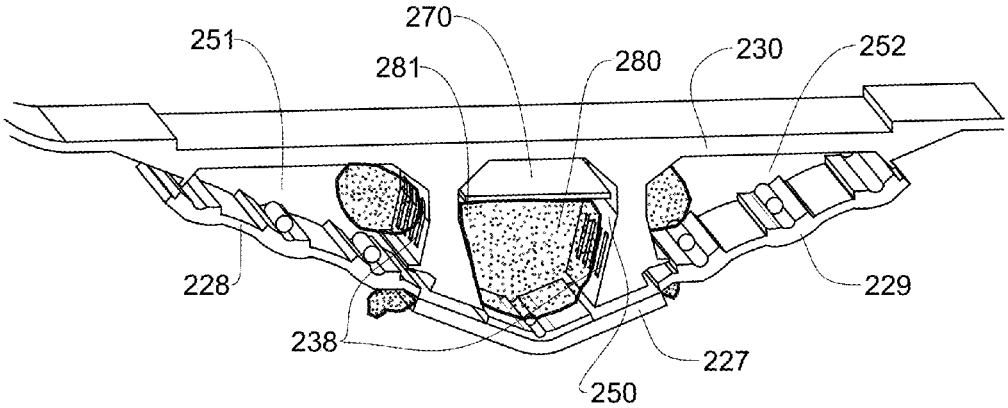

Attention is now directed to FIGS. 5A and 5D of the drawings illustrating an underbelly system 201 in accordance with another example of the presently disclosed subject matter. The underbelly system 201 is configured to be mounted as an add-on to a cabin structure (not shown) of a vehicle (not shown) so as to constitute an active armor system which provides an active protection against detonation of a threat under the vehicle.

As shown in FIGS. 5A and 5B, the underbelly system 201 comprises the followings components: a deflector 220; seven explosive charges 240; a support construction 230 configured for holding the deflector 220 and confining the explosive charges 240 therein; a sensing arrangement (not shown) configured for sensing an external detonation of a threat under the vehicle; and a control unit (not shown) in communication with the sensing arrangement and the explosive charges 240, for managing the operation of the underbelly system 201, and particularly to receive input from the sensing arrangement and to provide output to the selected explosive charges 240 and initiate their detonation.

As it is described in details below, the support construction 230 of the underbelly system 201 has a structure which forces the deflector to absorb more detonation force generated upon detonation of the selected explosive charges than the support construction 30 and respectively the cabin structure of the vehicle absorb. This structure allows exploiting the detonation force of the selected detonators for deflecting the shockwave in an efficient manner and reducing its non-desired influence on the cabin structure of the vehicle itself.

Although the underbelly system 201 has a different structure and a different number of explosive charges than the underbelly system 1, its method of operation is similar to the method of operation of the underbelly system 1 of FIG. 2.

The explosive charges 240 include a primary explosive charge 240*a* and six secondary explosive charges 240*b*, 240*c*, 240*d*, 240*e*, 240*f* and 240*g*. The explosive charges 240 are arranged widthwise perpendicularly to the axis X. The primary explosive charge 240*a* has a greater explosive power than the secondary explosive charges 240*b*, 240*c*, 240*d*, 240*e*, 240*f* and 240*g*.

The deflector 220 is an armor panel having ballistic characteristics which is disposed under the cabin structure of the vehicle and constitutes an underbelly of the vehicle. Each of the explosive charges 240 is mounted to a different deformable portion of the deflector 220 and configured, upon its detonation, for deforming its corresponding deformable portion of the deflector 220 in a direction away from the cabin structure.

The deflector 220 is structured of a lowermost deflector central portion 227, a right deflector peripheral portion 228 and a left deflector peripheral portion 229, all extending along the axis X. The right and left peripheral portions 228 and 229 are elevated above the deflector central portion 227.

The support construction 230 is formed of a horizontal reinforcing rib 232 and two vertical reinforcing ribs 234 and 236. The reinforcing ribs 232, 234 and 236 define three channels extending along a longitudinal axis X of the vehicle, including: a primary channel 250 associated with the deflector central portion 227, a right secondary channel 251 associated with the right peripheral portion 228, and a left secondary channel 252 associated with the left peripheral portion 229.

In particular, the primary channel 250 has an upper channel portion 250*a* which is substantially parallel to a floor of the cabin structure of the vehicle, and two side channel portion 250*b* and 250*c* which are substantially perpendicular to the upper channel portion 250*a*. The right secondary channel 251 has an upper channel portion 251*a* and a side channel portion 251*b*. The left secondary channel 252 has an upper channel portion 252*a* and a side channel portions 252*b*.

The primary explosive charge 240*a* is attached to an inner surface 227*a* of the deflector central portion 227 and is enclosed by the primary channel 250. The secondary explosive charges 240*b*, 240*c* and 240*d* are attached to an inner surface 228*a* of the right peripheral portion 228 and are enclosed by the secondary channel 251. The secondary explosive charges 240*e*, 240*f* and 240*g* are attached to an inner surface 229*a* of the left peripheral portions 228 and are enclosed by the secondary channel 252.

As shown in FIGS. 5A and 5B, the explosive charges 240 are disposed in proximity the deflector 220 and are space from the upper and the side portions of the channels 250, 251 and 252. This structure of the support construction 230 and the disposition of the explosive charges therein allow the deflector 220 to absorb most of the detonation force generated upon detonation of the explosive charges 240. In other words, the detonation pressure that is generated upon the detonation of the explosive charge is greater on the deformable portions of the deflector 220 than on the upper and the side portions of the channels 250, 251 and 252, which results in greater deformation of the deformable portions of the deflector and reduced pressure on the cabin structure of the vehicle. This effect is achieved due to the space between the explosive charges 240 and the inner surfaces of the channels 250, 251 and 252 which accommodates at least a part of the explosive gases generated upon detonation of the explosive charges 240, thereby reducing the pressure actuated on the cabin structure of the vehicle by the explosive gases.

In addition, the channels 250, 251 and 252 have an elongate shape which allows them to direct therealong at least a part of explosive gases generated upon detonation of the explosive charges 240, and thereby reducing pressure actuated on the cabin structure of the vehicle by the explosive gases.

The support construction further comprises a gas evacuation mechanism in the form of openings 238 formed in the vertical reinforcing ribs 234 and 236. The openings 238 are configured for evacuating at least part of the explosive gases that are generated in the primary channel 250 upon detonation of the primary explosive charge, in a direction transverse to the axis X, and particularly into the right and left secondary channels 251 and 252. This evacuation of the explosive gases allows reducing the influence of the detonation force of the explosive charges on the cabin structure, and increasing their influence for deforming the deflector 220 so as to deflect the shockwave of the external detonation under the vehicle.

The number the openings 238 and the distances therebetween is determined so as to allow as much gases to pass therethrough, while preserving strong enough structure of the support construction 230 to be stable to the detonation of the explosive charges and to the external detonation.

The primary channel 250 includes a protective plate 270 disposed between the primary charge 240*a* and the upper channel portion 250*a* of the primary channel. The protective plate 270 is substantially parallel to the upper channel portion 250*a*. The protective plate 270 is configured for substantially preventing influence of the detonation of the explosive charge on the cabin structure of the vehicle and for directing the explosive gases towards the openings 238.

As shown in FIGS. 5C and 5D, when the primary explosive charge 240*a* is detonated, explosive gases 280 are generated within a primary channel space 281 of the primary channel 250. The fact the primary explosive charge 240*a* is proximal to the deformable portion 227 and spaced from the upper and side portions of the support construction with the primary channel space 281 therebetween allows accommodating the explosive gases 280, thereby reducing their influence on the support construction. This also results in a detonation pressure that is generated upon the detonation of the explosive charge than on the support structure.

As shown in FIG. 5D, the elongate shape of the primary channel 250, the distance between the primary explosive charge 240*a* and the structural support 230, the existence of the protective plate 270 and the existence of the openings 238, provides enough space for accommodating the explosive gases 280 within the primary channel 250, and directing along this channel and to the secondary channels 251 and 252. The result of this structure is such that the detonation pressure that is generated upon the detonation of the explosive charge 240*a* is greater on the deformable portion than on the support structure, so that an effective deformation of the deformable portion 227 is achieved.

As can further be seen in FIG. 5D, the detonation of the primary explosive charge 240*a* causes the deflector central portion 227 and the deflector peripheral portions 228 and 229 to at least partially disconnect from each other. This disconnection allows allowing evacuation of at least a part of the explosive gases 280 from the interior of the underbelly system.

The invention claimed is:

1. An underbelly system for a vehicle, comprising:

a deflector configured to be disposed under a cabin structure of the vehicle and constitute an underbelly thereof;

a plurality of explosive charges, each of the plurality of explosive charges being associated with a different deformable portion of the deflector and configured, upon charge detonation, for deforming a corresponding deformable portion of the deflector to project in a direction away from the cabin structure relative to an original structure thereof;

a sensing arrangement configured for sensing an external detonation under the vehicle and obtaining detonation data of the external detonation; and a control unit, in communication with the sensing arrangement and the plurality of explosive charges, configured for:

receiving said detonation data;

analyzing said detonation data to characterize a shockwave generated upon said external detonation;

selecting two or more of said plurality of explosive charges such that sequential detonation of said selected two or more of said plurality of explosive charges will gradually deflect said characterized shockwave during the progression thereof; and initiating said sequential detonation of said selected two or more of said plurality of explosive charges.

2. The underbelly system according to claim 1, wherein the sequential detonation of the selected explosive charges is configured to cause at least a portion of the deflector, optionally the portion whose associated explosive charge is detonated first, to project in a direction away from the cabin structure to a greater extent than that obtained in said portion upon simultaneous detonation of the selected charges.

3. The underbelly system according to claim 1, wherein the control unit is configured to characterize said shockwave for odtaining shockwave parameters including one or more of the following: a location of a peak of the shockwave, a direction at which the shockwave progresses, a duration of the shockwave, a magnitude distribution of the shockwave, or a spatial geometry of the shockwave.

4. The underbelly system according to claim 3, wherein the control unit is further configured for determining said sequential detonation by calculating a detonation sequence according to said shockwave parameters.

5. The underbelly system according to claim 1, wherein the two or more selected explosive charges include at least one first explosive charge and at least one second explosive charge configured to be detonated following the detonation of the first explosive charge.

6. A vehicle having the underbelly system according to claim 1.

7. A method for protecting a vehicle having an underbelly system, the underbelly system including: a deflector configured to be disposed under a cabin structure of the vehicle and constitute an underbelly thereof; a plurality of explosive charges, each of the plurality of explosive charges being associated with a different deformable portion of the deflector and configured, upon charge detonation, for deforming a corresponding deformable portion of the deflector to project in a direction away from the cabin structure relative to an original structure thereof; a sensing arrangement; and a control unit, in communication with the sensing arrangement and the plurality of explosive charges, said method comprising:

sensing by the sensing arrangement external detonation under the vehicle, obtaining detonation data and providing the detonation data to the control unit;

receiving said detonation data from the sensing arrangement at the control unit;

analyzing said detonation data by said control unit to characterize said shockwave generated upon said external detonation;

selecting, by the control unit, said two or more of said plurality of explosive charges such that sequential detonation of said selected two or more of said plurality of explosive charges will gradually deflect said characterized shockwave during the progression thereof; and initiating, by the control unit, the sequential detonation of said two or more selected explosive charges.

8. The method according to claim 7, further comprising characterizing said shockwave for obtaining shockwave parameters including one or more of the following: a location of a peak of the shockwave, a direction at which the shockwave progresses, a duration of the shockwave, a magnitude distribution of the shockwave, or a spatial geometry of the shockwave.

9. The method according to claim 8, further comprising determining, by the control unit, said sequential detonation by calculating a detonation sequence.

* * * * *